US009174446B2

(12) United States Patent
Marler et al.

(10) Patent No.: US 9,174,446 B2
(45) Date of Patent: Nov. 3, 2015

(54) DIGITAL PRINTING PRESS HAVING A MODULAR AND RELIABLE INK DELIVERY SYSTEM

(71) Applicant: APS Engineering, Escondido, CA (US)

(72) Inventors: Jaren Dayle Marler, Escondido, CA (US); Mark Lauren Baker, Escondido, CA (US); William Scott Colburn, San Diego, CA (US)

(73) Assignee: APS ENGINEERING, Escondido, CA (US)

( * ) Notice: Subject to any disclaimer, the term of this patent is extended or adjusted under 35 U.S.C. 154(b) by 0 days.

(21) Appl. No.: 14/519,992

(22) Filed: Oct. 21, 2014

(65) Prior Publication Data

US 2015/0165764 A1 Jun. 18, 2015

Related U.S. Application Data

(60) Provisional application No. 61/893,781, filed on Oct. 21, 2013.

(51) Int. Cl.

| | |
|---|---|
| ***B41J 2/175*** | (2006.01) |
| ***B41J 2/145*** | (2006.01) |
| ***B41J 2/17*** | (2006.01) |
| ***B41J 2/18*** | (2006.01) |

(52) U.S. Cl.

CPC .. *B41J 2/145* (2013.01); *B41J 2/17* (2013.01); *B41J 2/175* (2013.01); *B41J 2/17563* (2013.01); *B41J 2/17596* (2013.01); *B41J 2/18* (2013.01)

(58) Field of Classification Search

CPC ..... B41J 2/17; B41J 2/17563; B41J 2/175; B41J 2/18; B41J 2/17596

See application file for complete search history.

(56) References Cited

U.S. PATENT DOCUMENTS

| | | | | |
|---|---|---|---|---|
| 8,033,624 | B2 | 10/2011 | Silva et al. | |
| 8,550,612 | B2 | 10/2013 | Park et al. | |
| 8,556,398 | B2 | 10/2013 | Gunnell et al. | |
| 2008/0186353 | A1 | 8/2008 | Parks et al. | |
| 2008/0231670 | A1 * | 9/2008 | Brown et al. | 347/85 |

FOREIGN PATENT DOCUMENTS

| | | | |
|---|---|---|---|
| WO | WO 2012054017 A1 * | 4/2012 | B41J 2/175 |

OTHER PUBLICATIONS

International Search Report and Written Opinion for PCT/US2014/061595 Dated: Jan. 14, 2015 pp. 15.

* cited by examiner

*Primary Examiner* — Julian Huffman

(74) *Attorney, Agent, or Firm* — Harness, Dickey & Pierce, P.L.C.

(57) ABSTRACT

A printing system that comprises a media transport system for conveying a print media along a media path in a first direction. A plurality of print modules each spanning the print media path along a second direction. Each print module defines a major axis along the second direction. A minor axis that aligns along the first direction and an intermediate axis with each of the print modules. A printhead array that includes printheads spaced from the media path. A fluid regulator portion configured to regulate a fluid pressure in the printhead portion. Each of the print modules are configured to be installed into and removed from the printing system as an integral unit.

16 Claims, 7 Drawing Sheets

DIGITAL PRINTING PRESS HAVING A MODULAR AND RELIABLE INK DELIVERY SYSTEM

CROSS-REFERENCE TO RELATED APPLICATIONS

This application claims priority to U.S. Provisional Patent Application Ser. No. 61/893,781 filed Oct. 21, 2013. The entire disclosure of the above application is incorporated herein by reference.

FIELD OF THE INVENTION

This invention relates to a media-wide digital printing system with an improved ink delivery system. More particularly this invention relates to a modular ink delivery system with removable components with modular components.

BACKGROUND

The application of digitally controlled inkjet technology to processes heretofore carried out by analog presses is becoming widespread. Applications including the printing of film-based packaging and labels have historically been performed by flexographic or rotogravure based analog printing presses. Such analog printing presses accept a roll of print media material which is unwound and passed through various processes including printing and curing of ink. Printing occurs between wetted drums having physically imaged surfaces and the web media. Each drum applies a single primary color sub-image and the ink is typically cured or set between the application of each different primary color. Such a process is very efficient for large batches of a given printed image but does require changing drums in order to print a new image.

Inkjet digital web presses offer an advantage of being able to change a printed design without changing a drum. Inkjet presses pass print media under "print bars" which have arrays of inkjet printheads that span the print zone. These print bars are under computer control and allow printed designs to be rapidly changed within a reel of material thus eliminating a new printer setup for a new printed image. Inkjet web presses are particularly advantageous for "short run" printing in which only a relatively small number of a particular print design are required. In fact, every print can be different—an example might be packaging with an embedded serial number that changes with each package.

Although shown to be advantageous for digital presses, inkjet printing has historically been optimized for home printers using small disposable cartridges. A big challenge for inkjet printing in digital presses is the need to properly deliver ink to the printheads. Typical inkjet printheads eject droplets of ink from very tiny nozzles that refill themselves via capillary action. For proper function of the nozzles and to avoid problems such as "drooling" the ink needs to be delivered to the printheads at a carefully controlled pressure. Typically this pressure is a slightly negative "gauge" pressure meaning that it is slightly below the pressure of the surrounding atmosphere. In some embodiments this pressure may be in a range from about −0.5 to about −3.0 inches of water although the optimal gauge pressure may vary according to various factors such as ink surface tension and nozzle size.

Systems for providing ink in this manner in digital presses have typically been quite complicated and have required high maintenance. Some have involved modulating the pressure using electrically controlled air pressure regulators as one example. While prior art systems have been made to work there is an ongoing need to provide simple designs that are inherently reliable and reduce maintenance and downtime costs.

DETAILED DESCRIPTION

Figure 1:
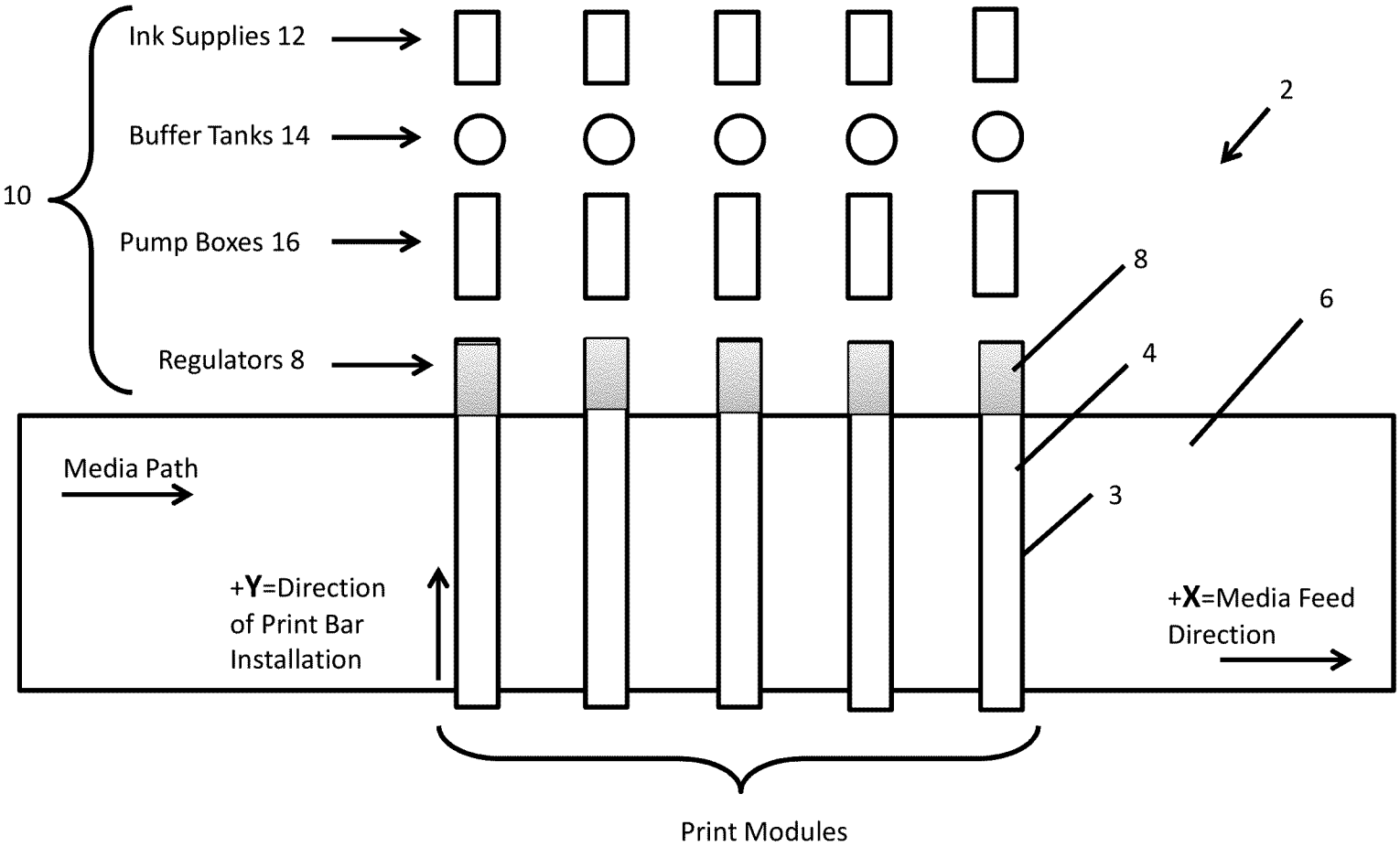
FIG. 1 is a plan view of a printing system.

An exemplary embodiment of a printing system is indicated as 2 in FIG. 1. A set of print modules 4 each span a media path 6 along which a print media is transported in a first lateral direction X. For descriptive purposes the media path 6 may be used interchangeably with media 6 moving along the media path. As the media moves in direction X the print modules 4 eject a dot matrix pattern of ink drops thereon to form images and text. The print media 6 can be paper or it can be any other suitable substrate material such as flexible packaging or labels. The ink being ejected can be any suitable in for the substrate, including aqueous, solvent, or UV (ultraviolet curable) inks just to name some examples. Alternatively other fluids such as adhesives may be ejected by print modules 4.

In one preferred embodiment print modules 4 each include an array 3 of piezoelectric inkjet printheads for ejecting fluid onto the print media. Array 3 preferably spans print media path 6. Alternatively the print modules 4 may include arrays 3 of thermal inkjet printheads or other fluid ejection technologies. In yet another preferred embodiment each print module 4 includes one very large printhead 3 that spans media path 6.

In the first preferred embodiment each print module 4 includes a regulator portion 8 for regulating the pressure of ink being delivered to the inkjet printheads. The regulator portion 8 is preferably integral with print module 4 whereby print module 4 is integrally removable and replaceable along with regulator portion 8. Regulator 8 is preferably part of an ink delivery system 10 which also includes ink supplies 12, buffer tanks 14, and ink supply control modules 16 (referred to in figures as pump boxes 16 for simplicity). The functions of each of these portions of the ink delivery system 10 are described in in more detail below.

Printing system 2 and print module 4 will be described with respect to axes X, Y, and Z. First lateral axis X is a media feed direction along media path 6. Second lateral axis Y is a cross-media direction along which inkjet printheads are distributed to span the print media. A third vertical axis is normal to a plane defined by X and Y may be thought of as "out of the page and toward the viewer" in FIG. 1. Each print module 4 defines a major lateral axis length along Y, an intermediate vertical axis length along Z, and a minor lateral axis length along X. The axis lengths together define a bounding box that contains print module 4. Each print module 4 has a major lateral axis length along Y of at least 8 inches, at least 12 inches, at least 18 inches, or at least 24 inches, or longer. In various alternative preferred embodiments the major lateral axis length along Y may be more than 8 inches, more than 12 inches, more than 18 inches, more than 24 inches or even longer.

Figure 2A:
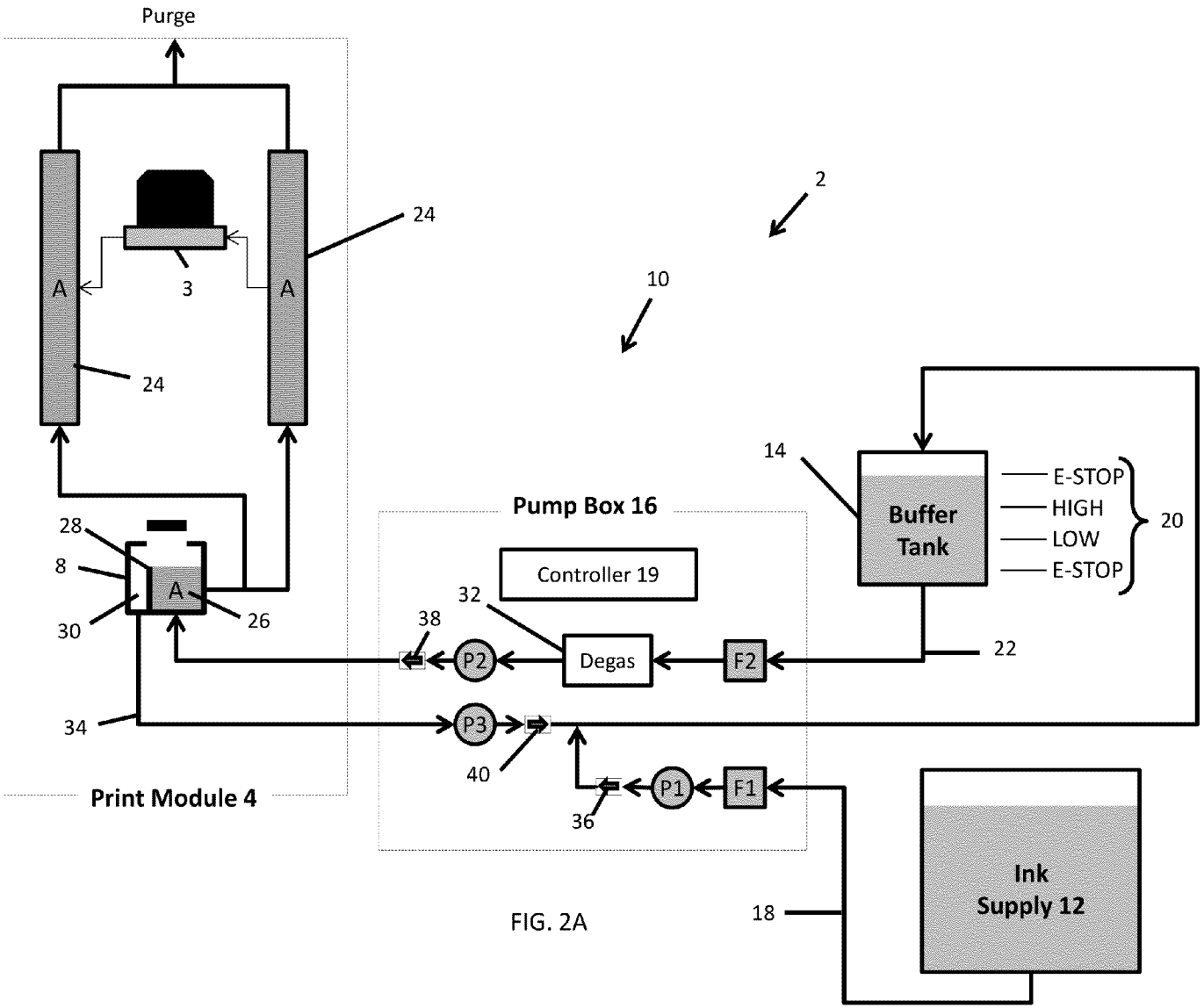
FIG. 2A is a block diagram of a printing system with an ink delivery system in accordance with the principles of this invention.

FIG. 2A is a functional block diagram of a first preferred embodiment of printing system 2 showing the ink delivery system 10. As shown in FIG. 2A ink delivery system 10 includes is an ink supply control module 16 (depicted and also referred to as pump box 16 for simplicity in FIG. 2A. A pump box 16 is coupled to the replaceable ink supply 12, the buffer tank 14, and print module 4 orchestrates and controls ink flow between the various components of the ink delivery system 10.

The pump box 16 controls ink flow along three fluid paths in order to provide at least three functions including: (1) maintaining the ink level in the buffer tank 14 within a specified range, (2) maintaining an ink flow into the regulator 8 to thereby maintain a proper ink level and proper delivered pressure of ink from the regulator 8, and (3) removing excess ink from the regulator 8. The three fluid paths 18, 22, and 34 will now be described in more detail. The pump box 16 preferably includes filters F1 and F2, degas unit 32, pumps P1-P3, and check valves 36, 38, and 40. The pump box 16 preferably also includes a controller 19 that receives various inputs including an input from a sensing system 20. The controller 19 has outputs for controlling other pumps within the pump box 16.

The pump box 16 defines and controls a first fluid path 18 which includes filter F1, pump P1, and check valve 36. The first fluid path 18 couples ink supply 12 to buffer tank 14. The pump box 16 controls fluid flow in first fluid path 18 in order to maintain an ink level in the buffer tank 14 to within a specified range. The buffer tank 20 preferably has a sensing system 20 that includes a liquid level sensor of which there are several well known types, including those based on optical sensing, capacitance, resistance, and flotation. The sensing system 20 is coupled to controller 19 which is responsive to ink levels sensed by the sensing system 20. The controller 19 controls pump P1 to generally maintain the ink level in buffer tank 14 to within a specified range (indicated as between "HIGH" and "LOW" in FIG. 2A). The pump P1 thereby periodically pumps ink from the ink supply 12 to the buffer tank 14 to maintain the specified ink level range in the buffer tank 14. When the ink supply 12 is exhausted then the ink level in the buffer tank 14 may fall below a LOW level and reach a lower "E-STOP" level at which point printing must cease until ink supply 12 is refilled or replaced. If the ink level rises above the an upper "E-STOP" level this may indicate a system malfunction, and printing can cease until the malfunction can be addressed.

Each print module 4 includes a printhead array 3 that receives ink from an ink inlet manifold 24. In some embodiments there may be two ink inlet manifolds 24 in which ink is supplied from both ends of each printhead in order to reduce fluid path resistance. The ink inlet manifold 24 receives ink from an ink fluid chamber 26 which forms a portion of fluid regulator 8. The height of a top surface of fluid in the ink fluid chamber 26 determines the pressure of fluid being delivered to ink inlet manifold 24.

The height of fluid in the ink fluid chamber 26 is preferably determined according to a weir structure within the regulator 8. The regulator 8 includes a fluid weir 28 that separates the ink fluid chamber 26 from a fluid sump 30. As ink is consumed from the fluid chamber 26 the height of fluid in fluid chamber 26 will decrease causing the pressure of the ink delivered to the inlet manifold 24 to decrease. However, by maintaining steady flow of ink over fluid weir 28 from the fluid chamber 26 to the fluid sump 30 a constant pressure of ink delivered to the inlet fluid manifold 24 can be maintained. Thus, the height of the fluid weir 28 can determine the pressure of the ink being delivered to the printhead array 3.

The pump box 16 maintains the fluid flow from the fluid chamber 26 to the sump 30. The pump box 16 defines and controls the second fluid path 22 which includes the filter F2, the degas unit 32, the pump P2, and a check valve 38. During a printing operation the pump box 16 can maintain a constant flow of ink over the weir 28 thereby maintaining a consistent pressure level of ink delivered from the fluid chamber 26 to the manifold 24. The degas unit 32 removes dissolved air from the ink passing through the second fluid path which reduces or eliminates bubble growth in the printhead array 3 thereby improving reliability and consistency.

To prevent the sump 30 from filling the pump module 16 also pumps and thereby transfers ink from the fluid sump 30 to the buffer tank 14. The pump box 16 defines third fluid path 34 including the pump P3 and a check valve 40 for pumping the ink from the sump 30 to the buffer tank 14. As indicated, every fluid path includes a check valve in each fluid path to reduce or eliminate "backflow" through a given fluid path. The check valve 36 in the first fluid path 18 prevents the pump P3 from pumping fluid from the sump 30 back into the ink supply 12. The check valve 38 in the second fluid path 22 prevents backflow from the fluid chamber 26 to the buffer tank 14. The check valve 40 in fluid path 34 prevents backflow from the buffer tank 14 or the pump P1 from pushing ink into the sump 30.

Figure 2B:
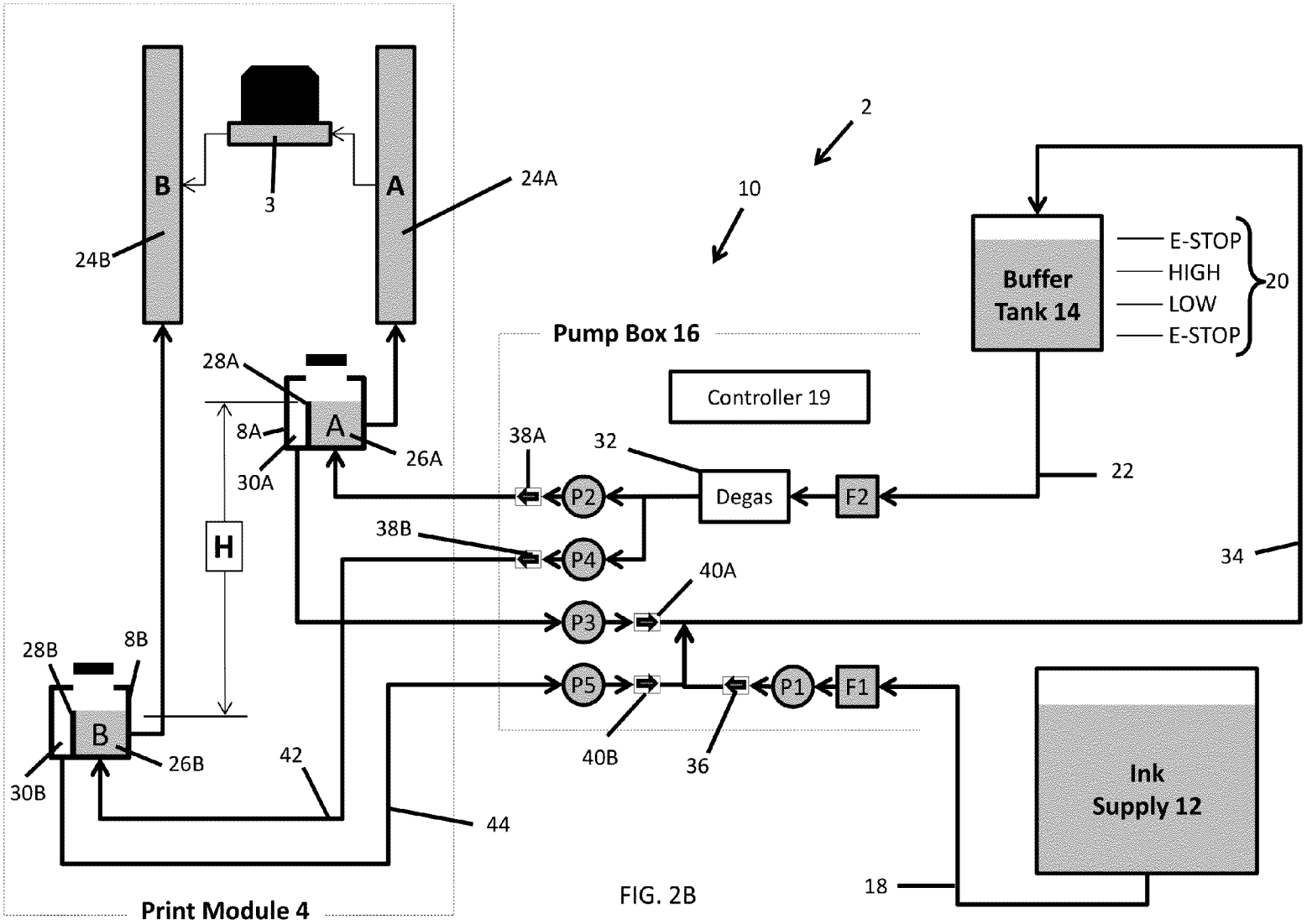
FIG. 2B is a block diagram of a printing system with an ink delivery system in accordance with a second embodiment of this invention.

FIG. 2B is a functional block diagram of a second embodiment of printing system 2 with a second preferred embodiment of an ink delivery system 10'. Ink delivery system 10' shown in FIG. 2B is similar to ink delivery system 10 shown in FIG. 2A, and corresponding parts are identified with corresponding reference numerals. However the ink delivery system 10' of the second embodiment utilizes two weirs 28A and 28B rather than one in order to regulate pressure at both an inlet (A) and outlet (B) of each inkjet printhead. In the preferred embodiment the inlet pressure (A) is higher than the outlet pressure (B). In an alternative embodiment the inlet pressure (A) is equal to the outlet pressure (B).

The print module 4 includes a printhead array 3 that is in turn coupled to an inlet ink manifold 24A and an ink outlet manifold 24B. The ink inlet manifold 24A provides ink to an ink inlet of each printhead of printhead array 3. The ink outlet manifold 24B receives ink from the ink outlet of each printhead of printhead array 3. The ink inlet and outlet manifolds 24A and 24B each are fluidly coupled to the fluid pressure regulators 8A and 8B respectively. The fluid pressure at the inlet ink manifold 24A and hence at each ink inlet of the printhead array 3 is determined by the height of fluid in the first chamber 26A. The fluid pressure at the outlet ink manifold 24B and hence at each ink outlet of the printhead array 3 is determined by the height of fluid in the first chamber 26B. If ink is properly flowing over the weirs 28A and 28B then the fluid pressure in each chamber 26A/B is determined by the physical height of each weir 28A/B respectively. When the weir 28A is physically higher than the weir 28B the inlet pressure of each printhead is higher than the outlet pressure. This results in inlet to outlet circulation of ink through each printhead in printhead array 3. The height difference H between weir 28A and weir 28B creates an inlet to outlet pressure difference that is equal to the fluid height difference H. The pressure difference H thereby drives circulation through each printhead in printhead array 3.

As described above with respect to FIG. 2A, the pump box 16 is the "active" part of the ink delivery system 10. The pump box 16 is coupled to the ink supply 12, the buffer tank 14, and to the print module 4 and controls ink flow between the various components of ink delivery system 10. As shown in FIG. 2B, the pump box 16 controls ink flow along five fluid paths 18, 22, 34, 42, and 44. The pump box 16 contains filters F1 and F2, degas unit 32, pumps P1-P5, and check valves 36, 38A and 38B, and 40A and 40. The pump box 16 includes controller 19 that receives various inputs including an input from the sensing system 20. The pump box 16 has outputs for controlling all five pumps P1-P5 contained within the pump box 16.

The pump box 16 defines a first fluid path 18 that includes filter F1, pump P1, and check valve 36. The first fluid path 18 couples the ink supply 12 to the buffer tank 14. The operation of the pump box 16 with respect to the first fluid path is similar to that described above with respect to FIG. 2A. The pump box controller 19 is responsive to signals from the fluid sensing system 20 to control the fluid level in the buffer tank 14 between "HIGH" and "LOW" ink levels. The pump controller 19 activates the pump P1 as necessary to maintain the ink level in buffer tank 14 within the specified range.

The pump box 16 defines a second fluid path 22 which includes filter F2, degas unit 32, pump P2, and check valve 38A. The second fluid path 22 couples the buffer tank 14 to the first fluid chamber 26A. The pump box controller 19 operates pump P2 to maintain a fluid flow of ink over first weir 28A from the first fluid chamber 26A to the first sump 30A in order to maintain a consistent height of fluid in the first fluid chamber 26A. The degas unit 32 removes dissolved gas in the ink passing through the second fluid path 22.

The pump box 16 defines a third fluid path 34 which includes pump P3 and check valve 40A. Third fluid path couples the first sump 30A to the buffer tank 14. The Controller 19 operates the pump P3 to keep the sump 30A from overfilling.

The pump box 16 defines and controls a fourth fluid path 42 which includes filter F2, degas unit 32, pump P4, and check valve 38B. The fourth fluid path 42 couples the buffer tank 14 to the second fluid chamber 26B. The pump box controller 19 operates the pump P4 to maintain a fluid flow of ink over the second weir 28B from the second fluid chamber 26B to the second sump 30B. The degas unit 32 removes gas ink passing through the fourth fluid path 42.

The pump box 16 defines and controls a fifth fluid path 44 which includes pump P5 and check valve 40B. The pump box 16 pumps ink along sixth fluid path 44 from the second sump 30B to the buffer tank 14 to prevent the sump 30B from overfilling.

As with FIG. 2A there are check valves to maintain the integrity and individual control of each fluid path. In the first fluid path, the valve 36 prevents backflow into ink supply 12. The check valves 38A and 38B prevent backflow into the buffer tank 14 for fluid paths two and four respectively. The check valves 40A and 40B prevent backflow into the sumps 30A and 30B respectively for fluid paths three and five respectively.

Figure 3:
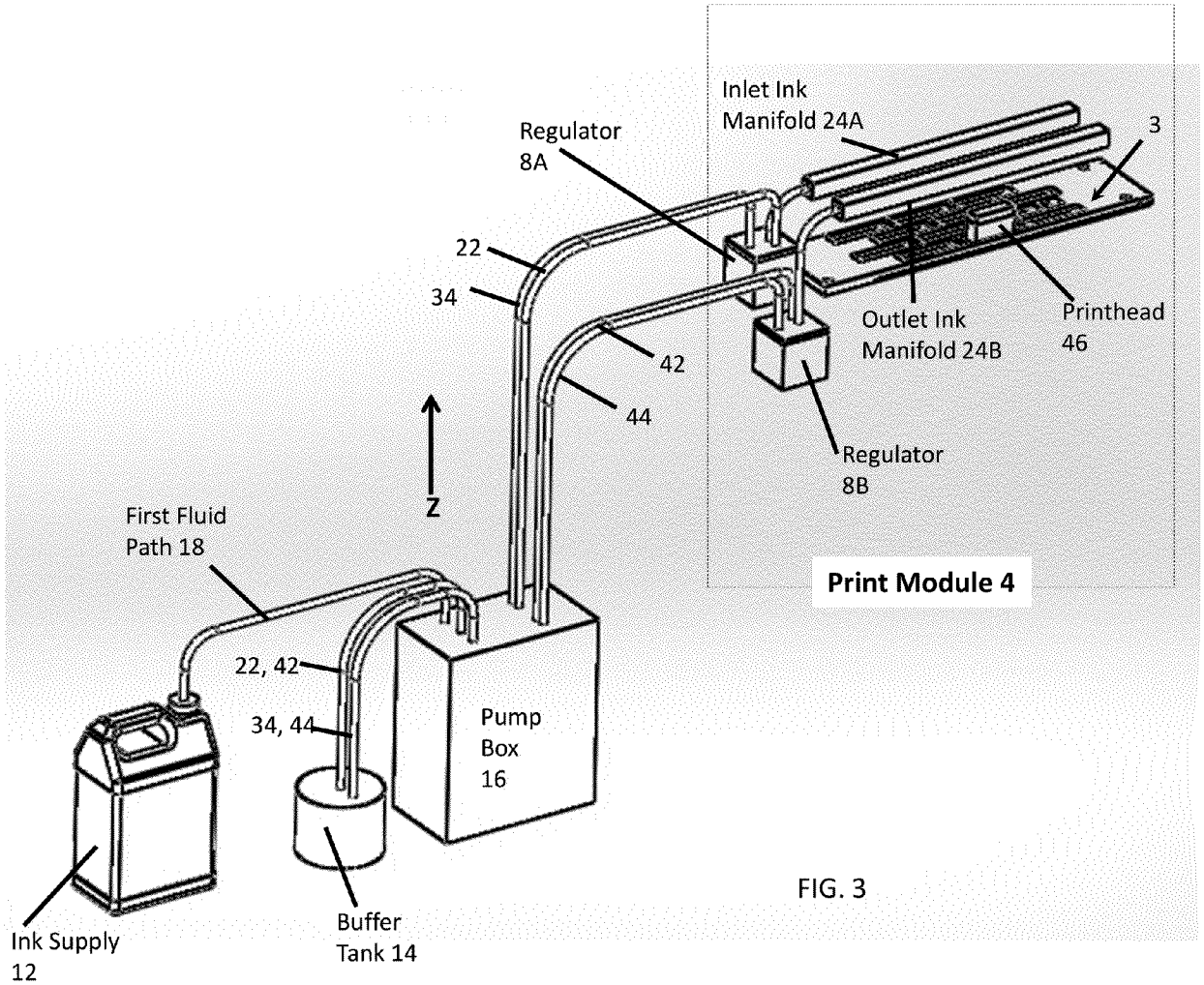
FIG. 3 is an isometric view of a printing system illustrating the ink delivery system in accordance with the second preferred embodiment, showing a single printhead module.

FIG. 3 shows the dual weir embodiment of FIG. 2B of printing system 2 for a single print module 4 and its associated ink delivery system 10 in schematic isometric form. Only one printhead 46 is shown of the printhead array 3. The printhead 46 has an inlet and an outlet that receive ink from the inlet manifold 24A and the outlet ink manifold 24B respectively. The regulator units 8A and 8B are coupled to the manifolds 24A and 24B respectively. The regulator unit 8A is illustrated as higher than the regulator 8B to illustrate the regulator unit 8A delivering a higher inlet pressure than the outlet pressure delivered by the regulator unit 8B. The illustrated height difference is meant to illustrate an embodiment wherein a height difference in the fluid chamber levels between the regulators as was described with respect to FIG. 2B.

The pump box 16 is illustrated as having a single flow path 18 to the ink supply 12 for receiving ink from the ink supply 12. The pump box 16 is illustrated as having two flow paths to the buffer tank 14. One of these flow paths corresponds to the fluid paths 22 and 42 for delivering ink from the buffer tank 14 to the fluid chambers within regulators 8A and 8B respectively. Another of these flow paths corresponds to the fluid paths 34 and 44 for returning ink from sumps within regulators 8A and 8B to the buffer tank 14. The pump box is illustrated as having two flow paths to the regulator 8A corresponding to the fluid paths 22 and 34 and two flow paths to the regulator 8B corresponding to the fluid paths 42 and 44. The functions of all these flow paths are as described with respect to FIG. 2B.

Figure 4:
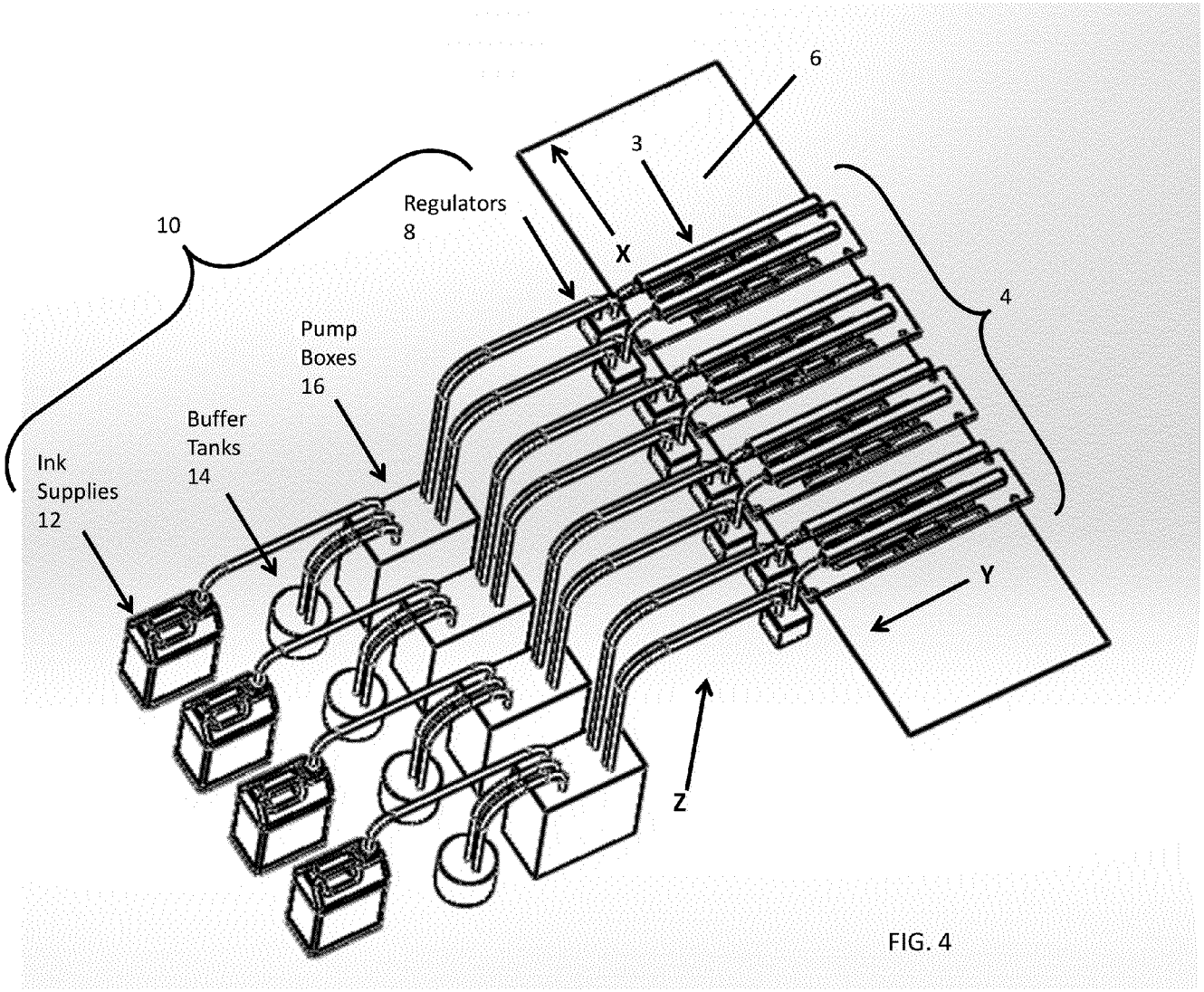
FIG. 4 is an isometric view of a portion of a printing system showing several print modules and their associated ink delivery components.

FIG. 4 is similar to FIG. 3 except that multiple print modules 4 and media path 6 are depicted. Print media 6 moves along media advance direction X. The print modules 4 span the width of the media path 6 along axis Y. Vertical axis Z is also shown. FIG. 4 also shows ink supplies 12, buffer tanks 14, pump boxes 16, and regulators 8 that form ink delivery system 10 for providing ink to printhead arrays 3.

With reference to FIGS. 2-4 a description of the functional aspects of the ink delivery system 10 components is warranted. The ink supplies 12 are replaceable and while depicted as bottles can take on a wide variety of forms. Additionally each ink supply 12 may have an ink level sensing system to warn an operator of a time to replace an ink supply 12. The buffer tanks 14 are utilized as an intermediate reservoir used to cycle ink through the weir structures of the pressure regulators 8. The regulators 8 are configured to maintain a consistent pressures in the printheads of printhead arrays 3. The pump boxes 16 actively orchestrate the transfer of ink from the ink supplies 12 to the buffer tanks 14 and between the buffer tanks 14 and the regulators 8.

Preferably, the only "active" component in the system is the pump box 16 which contains filters, degas unit, check valves, and pumps under control of a controller 19. The remainder of the ink delivery system components are passive in the sense that there are no controlled moving parts. The active portions of a typical ink delivery system tend to fail the most. This makes maintenance of the ink delivery system 10 very efficient. In the event of a failure of an active component of the ink delivery system 10, the malfunctioning pump box 16 can be quickly disconnected and replaced resulting in a minimal downtime for printing system 2.

Figure 5:
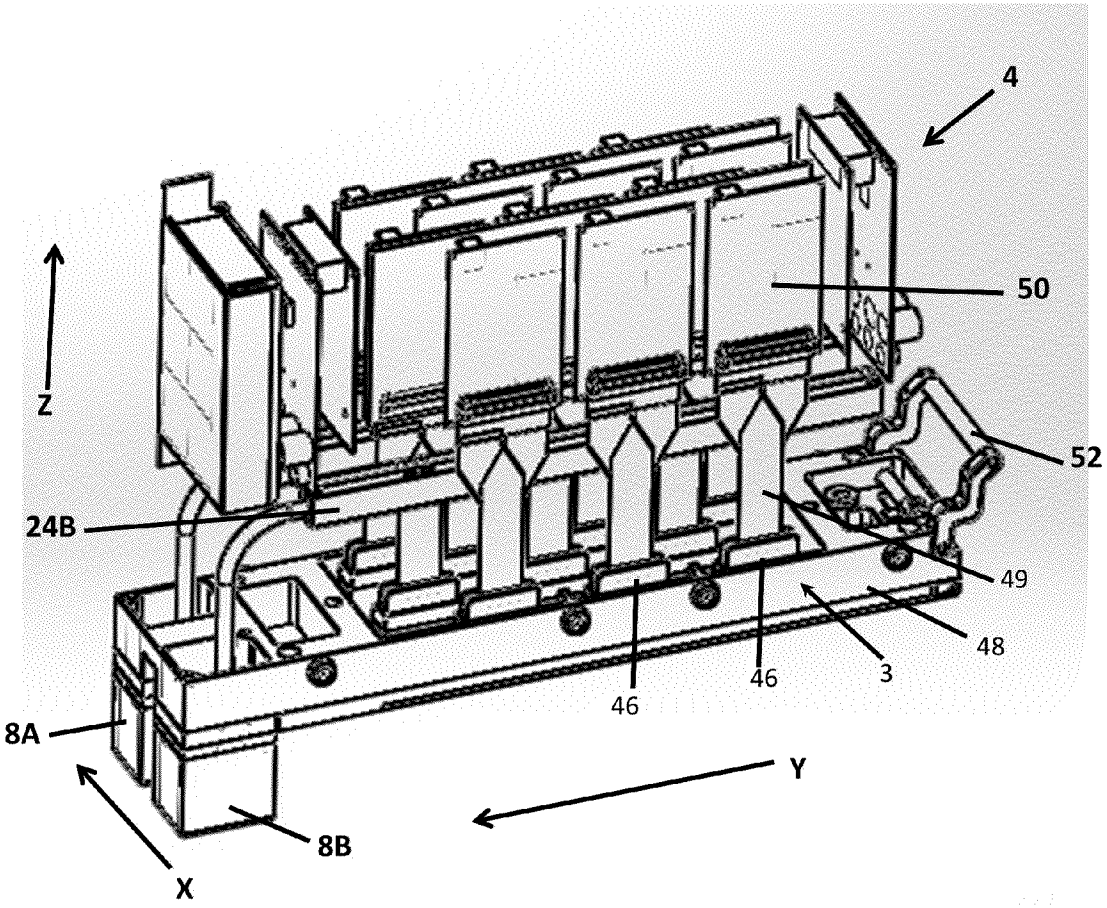
FIG. 5 is an isometric view of a single print module

FIG. 5 depicts a single printhead module 4. The printhead module 4 includes a supporting structure 48 that supports all of the major components of printhead module 4. The components include printheads 46, driver boards 50, and regulators 8A and 8B. A flexible cable 49 electrically couples each driver board 50 to its respective printhead 46 along vertical axis Z.

The printhead module 4 defines axes that define the smallest parallelepiped or 6 sided box that bounds printhead module 4. The defined axes include major, intermediate, and minor axes for the bounding box. The printhead module 4 defines the minor axis along first lateral axis X, the major axis along the second lateral axis Y, and the intermediate axis along vertical axis Z. The printhead module 4 is configured to be installed along second lateral axis Y into the printing system 2. The printhead module 4 including all components supported by the supporting structure 48 is configured to be installed and or removed from the printing system 2 as one integral unit. This includes regulators 8A and 8B that are secured to supporting structure 48. This has the advantage that the weirs 28A and 28B within the regulators are physically constrained to a fixed and stable height relative to the printheads 46 so as to provide a precise and controlled pressure of ink to the printheads 46. Also the regulators 8A and 8B may be factory tuned for the printheads of a given print bar. Nozzles sizes and the physical properties of the ink may affect the optimum pressure of ink to be delivered to the printheads 46 in a given print module 4.

Regulators 8A and 8B are disposed at a leading end of supporting structure 48 relative to the direction of installation (+Y). The printhead module includes a latch feature 52 at a trailing end of the supporting structure 48 relative to the direction of installation (+Y). Thus regulators 8A and 8B and latch feature 52 are at opposing ends of printhead module 4 relative to the major axis or axis Y. When the printhead module is installed in the printing system 2, the regulators 8A and 8B are to one lateral side of the paper path 6 relative to axis Y. The regulators 8A and 8B extend in a downward direction from supporting structure 48 relative to vertical axis Z.

As shown in the Figures, the regulators 8A and 8B are depicted as being physically at the same height in FIG. 5. However it is to be understood that the internal weirs within regulators 8A and 8B are configured to have a height according to the desired pressure of ink being delivered to the printheads 46 of the printhead array 3. The weirs are placed below the level of the printhead nozzles in order to provide a negative gauge pressure at the nozzles.

Figure 6:
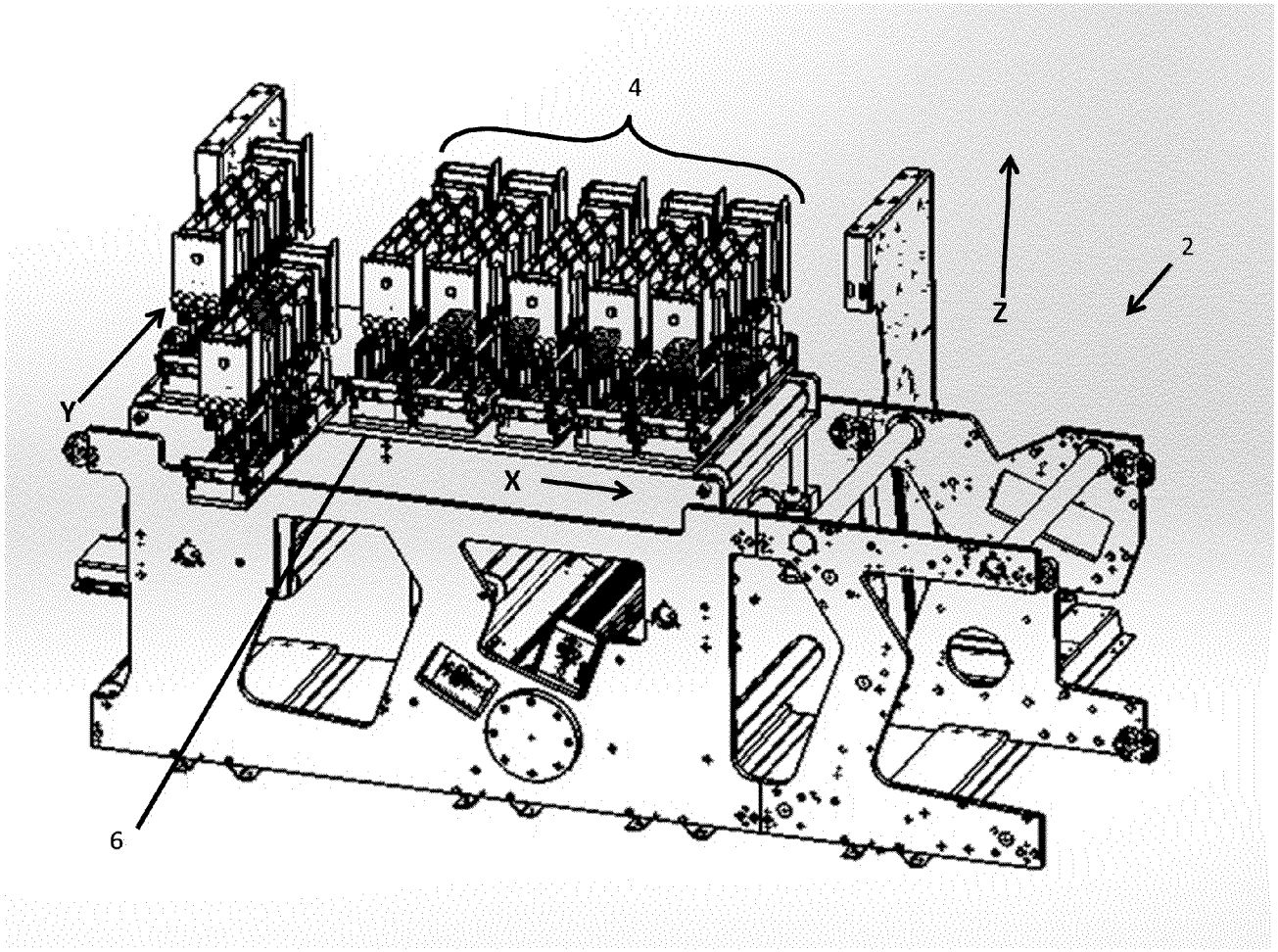
FIG. 6 is an isometric view of a printing system

FIG. 6 shows an exemplary printing system 2 with five modules 4 installed over media path 6. Also showing is the media advance direction X, module installation direction Y, and vertical axis Z.

Further areas of applicability will become apparent from the description provided herein. The description and specific examples in this summary are intended for purposes of illustration only and are not intended to limit the scope of the present disclosure.

What is claimed is:

1. A printing system comprising:

a media transport system for conveying a print media along a media path in a first direction;

a plurality of print modules each spanning the print media path along a second direction, each print module defining a major axis along the second direction, a minor axis aligned along the first direction, and an intermediate axis, each of the print modules including:

a printhead array including printheads spaced from the media path;

a fluid regulator portion configured to regulate a fluid pressure in the printhead, the regulator portion being disposed below the printhead array along the intermediate axis; and each of the print modules configured to be installed into and removed from the printing system as an integral unit.

2. The printing system of claim 1 wherein the regulator portion includes at least one fluid weir over which fluid flows from a fluid chamber to a sump, the height of the fluid weir determining the regulated fluid pressure.

3. The printing system of claim 1 wherein the fluid regulator is disposed at a first end of the print module and wherein the print module includes a latch at an opposite end relative to the major axis.

4. The printing system of claim 1 wherein the printhead module has a length along the major axis that is at least 12 inches.

5. The printing system of claim 1 wherein the printhead module is configured to be installed into the printing system in a direction aligned with the major axis.

6. The printing system of claim 1 wherein each printhead array includes a plurality of inkjet printheads each having a fluid inlet, each printhead module includes a fluid manifold above the printhead array and extending along the major axis, the manifold receiving ink from the regulator portion and delivering the ink to each of the fluid inlets.

7. The printing system of claim 6 wherein the fluid manifold includes a heating element for heating ink being delivered to the printhead portion.

8. A print module for installation into a printing system having a media path for conveying media along a first direction, the print module comprising:

a support structure defining a major axis and a minor lateral axis that are both perpendicular to a vertical axis;

a printhead array coupled to the support structure and configured to span the media path when the print module is installed in the printing system; and a fluid regulator portion coupled to a first end of the support structure and positioned on the support structure to be outside of the media path when the print module is installed into the printing system, the fluid regulator portion extending below the printhead portion with respect to the vertical axis when the print module is installed in the printing system, the fluid regulator portion regulating fluid pressure of ink delivered to the printhead array;

the print module being configured to be installed into the printing system as one integral unit.

9. The print module of claim 8 wherein the regulator portion includes at least one fluid weir over which fluid flows from a fluid chamber to a sump, the height of the fluid weir determining the regulated fluid pressure.

10. The print module of claim 8 further comprising a latch feature disposed at a second end of the support structure opposed to the first end relative to the major axis.

11. The print module of claim 8 wherein the support structure has a length along the major axis of at least 12 inches.

12. The print module of claim 8 wherein the print module is configured to be installed into the printing system in a direction aligned with the major axis.

13. The print module of claim 8 wherein the printhead array includes an array of inkjet printheads each having a fluid inlet and further comprising a fluid manifold extending along the major lateral axis and fluidically coupling the regulator portion to each of the fluid inlets.

14. The print module of claim 13 wherein the fluid manifold includes a heating element for heating ink being delivered to the printhead portion.

15. A print module for installation into a printing system having a media path for conveying media along a first direction, the print module comprising:

a support structure defining a major axis and a minor lateral axis that are both perpendicular to a vertical axis;

a printhead array coupled to the support structure and configured to span the media path when the print module is installed in the printing system, the printhead array including an array of inkjet printheads each having a fluid inlet and a fluid outlet; and a fluid regulator portion coupled to a first end of the support structure and positioned on the support structure to be outside of the media path when the print module is installed into the printing system, the fluid regulator portion including a first fluid regulator and a second fluid regulator regulating fluid pressure of ink delivered to the printhead array; the first and second fluid regulators each including a fluid weir structure in which the height of ink flowing over a fluid weir regulates the pressure of ink delivered to the inlet and outlet manifolds the print module further comprising a fluid inlet manifold extending along the major axis and fluidically coupling the first fluid regulator to each of the fluid inlets; and a second fluid inlet manifold extending along the major axis and fluidically coupling the second fluid regulator to each of the fluid outlets, and being configured to be installed into the printing system as one integral unit.

16. A printing system comprising:

a media transport system for conveying a print media along a media path in a first direction, the media path having a width in a second direction;

a plurality of print modules integrally removable from the printing system and each including:

a support structure;

a printhead array coupled to the support structure and spanning the media path along the second direction, the printhead array including a plurality of individual printheads each having a fluid inlet and a fluid outlet;

an inlet fluid manifold coupled to each of the fluid inlets;

a fluid outlet manifold coupled to each of the fluid outlets;

a first fluid regulator providing ink to the inlet manifold and a second fluid regulator providing ink to the outlet manifold each fluid regulator including a fluid weir over which ink flows from a fluid chamber to a fluid sump, the height of ink in the fluid chamber regulating a pressure of ink delivered to inkjet printheads.

* * * * *